US009711888B2

(12) United States Patent
Sawabe

(10) Patent No.: US 9,711,888 B2
(45) Date of Patent: Jul. 18, 2017

(54) CABLE ASSEMBLY WITH CONNECTOR AND CONNECTOR ASSEMBLY

(71) Applicant: 3M INNOVATIVE PROPERTIES COMPANY, St. Paul, MN (US)

(72) Inventor: Toshiyuki Sawabe, Tokyo (JP)

(73) Assignee: 3M Innovative Properties Company, St. Paul, MN (US)

( * ) Notice: Subject to any disclaimer, the term of this patent is extended or adjusted under 35 U.S.C. 154(b) by 0 days.

(21) Appl. No.: 15/008,535

(22) Filed: Jan. 28, 2016

(65) Prior Publication Data

US 2016/0268720 A1 Sep. 15, 2016

(30) Foreign Application Priority Data

Mar. 13, 2015 (JP) ..... 2015-050966

(51) Int. Cl.
*H01R 13/502* (2006.01)
*H01R 13/512* (2006.01)
*H01R 24/62* (2011.01)

(52) U.S. Cl.
CPC ..... *H01R 13/512* (2013.01); *H01R 24/62* (2013.01)

(58) Field of Classification Search
CPC ..... H01R 13/6215; H01R 13/6395; H01R 13/658; H01R 13/516; H01R 13/621; H01R 13/6275; H01R 13/6272; H01R 13/639
USPC ..... 439/453, 455, 452, 362, 470, 701
See application file for complete search history.

(56) References Cited

U.S. PATENT DOCUMENTS 4,456,319 A * 6/1984 Poulain Ricros .. H01R 13/6215 439/359
4,460,230 A * 7/1984 McKee ..... H01R 13/516 439/359
4,577,919 A * 3/1986 Waters ..... H01R 13/65802 439/362
4,634,203 A * 1/1987 Noyes ..... H01R 13/748 439/347
5,088,935 A * 2/1992 Dise ..... H01R 13/74 439/557
5,092,774 A * 3/1992 Milan ..... G01R 1/045 324/750.25

(Continued)

FOREIGN PATENT DOCUMENTS

JP H06-310087 11/1994
JP H11-345658 12/1999

*Primary Examiner* — Abdullah Riyami
*Assistant Examiner* — Vladimir Imas
(74) *Attorney, Agent, or Firm* — Robert S. Moshrefzadeh

(57) ABSTRACT

A cable assembly with connector includes: a housing provided with a mate connector opposing part provided on a front side and a cable part provided on a rear side having a cable opening formed; a conductive contactor provided on the mate connector opposing part side of the housing; a cable disposed in the housing via the cable opening and electrically connected to the contactor; a rear faceplate disposed on the cable part on the rear side of the housing and aligned with the cable opening; and a front faceplate disposed on the mate connector opposing part on the front side of the housing and enclosing a housing front face portion; wherein the housing is interposed between the rear faceplate and the front faceplate, and the front faceplate is fixed to the rear faceplate by at least one fixing member extending in the front and rear direction in the housing.

8 Claims, 7 Drawing Sheets

(56) References Cited

U.S. PATENT DOCUMENTS 5,158,481 A * 10/1992 Frantz ..... H01R 13/6581 439/607.58
5,288,244 A * 2/1994 Lien ..... H01R 12/7029 29/509
5,340,329 A * 8/1994 Hirai ..... H01R 13/6275 439/357
5,411,415 A * 5/1995 Embo ..... H01R 13/6592 439/607.5
5,647,758 A * 7/1997 Ichikawa ..... H01R 13/6215 439/362
5,820,412 A * 10/1998 Koegel ..... H01R 13/6593 439/607.51
5,859,766 A * 1/1999 Van Scyoc ..... H01R 13/6215 361/737
6,017,245 A * 1/2000 Karir ..... H01R 13/506 439/607.45
6,106,334 A * 8/2000 Kuo ..... H01R 13/6215 439/181
6,135,807 A * 10/2000 Lai ..... H01R 13/6593 439/455
6,312,294 B1 * 11/2001 Lai ..... H01R 23/688 439/692
6,343,957 B1 * 2/2002 Kuo ..... H01R 31/06 439/362
6,435,903 B1 * 8/2002 Nelson ..... H01R 13/71 174/57
6,527,572 B2 * 3/2003 Jou ..... H01R 13/6315 439/247
6,582,244 B2 * 6/2003 Fogg ..... H01R 13/621 439/362
6,592,387 B2 * 7/2003 Komenda ..... H01R 13/6315 439/247
6,625,016 B2 * 9/2003 Glusing ..... G06K 19/07743 361/679.41
6,688,903 B2 * 2/2004 Kakinoki ..... H01R 13/6215 439/362
6,736,667 B1 * 5/2004 Wu ..... H01R 13/6335 439/362
6,776,665 B2 * 8/2004 Huang ..... H01R 13/6581 439/352
6,821,140 B2 * 11/2004 Wu ..... H01R 13/6215 439/362
6,860,751 B1 * 3/2005 Huang ..... H01R 13/6215 439/362
6,866,533 B2 * 3/2005 Wu ..... H01R 13/6335 439/352
6,929,501 B2 * 8/2005 Huang ..... H01R 13/639 439/246
6,964,578 B2 * 11/2005 Clark ..... H01R 13/405 439/310
7,033,202 B2 * 4/2006 Wu ..... H01R 13/6215 439/362
7,037,131 B1 * 5/2006 Chen ..... H01R 13/6275 439/362
7,083,462 B1 * 8/2006 Chen ..... H01R 13/62966 439/362
7,124,505 B2 * 10/2006 Friesen ..... H01R 13/6215 29/825
7,163,412 B2 * 1/2007 Fan ..... H01R 13/6205 439/258
7,377,799 B2 * 5/2008 Kuo ..... H01R 13/6215 439/339
7,485,003 B2 * 2/2009 Mandrusov ..... H01R 13/6315 439/247
7,585,189 B2 * 9/2009 Wu ..... H01R 23/6873 439/362
7,614,903 B1 * 11/2009 Huang ..... H01R 13/5841 439/362
7,744,399 B1 * 6/2010 Gibbs ..... H01R 13/629 439/362
8,062,054 B2 * 11/2011 Su ..... H01R 13/502 439/362
8,113,870 B2 * 2/2012 Su ..... H01R 13/5816 439/455
8,992,249 B2 * 3/2015 Kobayashi ..... H01R 13/6591 439/362
2006/0166558 A1 7/2006 Katoh

* cited by examiner

CABLE ASSEMBLY WITH CONNECTOR AND CONNECTOR ASSEMBLY

TECHNICAL FIELD

One aspect of the present invention is related to a cable assembly with connector and a connector assembly.

BACKGROUND ART

In patent document 1, a cable assembly with connector is described provided with a housing, a conductive contactor provided on a front face side of the housing that can be fitted to a contactor of a corresponding connector, and a cable provided on a rear face side of the housing and connected electrically to the contactor. A screw member is provided on both sides of the housing of the cable assembly with connector for coupling to a connector of a corresponding mate side.

PRIOR ART DOCUMENTS

Japanese Unexamined Patent Application Publication No. 2006-202679

SUMMARY OF THE INVENTION

With the cable assembly with a connector as described above, leakage of electromagnetic waves relative to the circumferential direction of the housing can be suppressed by covering with the housing. Meanwhile, there has been a possibility that electromagnetic waves could leak from the front face side of the housing where the contactor is provided. Accordingly, more certain suppression of the leakage of electromagnetic waves from the housing has been demanded.

Means of Solving the Problem

The cable assembly with connector according to one aspect of the present invention includes: a housing provided with a mate connector opposing part provided on a front side and a cable part provided on a rear side having a cable opening formed; a conductive contactor provided on the mate connector opposing part side of the housing, that can fit with the contactor of a corresponding connector; a cable disposed in the housing via the cable opening and electrically connected to the contactor; a rear faceplate disposed on the cable part on the rear side of the housing and aligned with the cable opening; and a front faceplate disposed on the mate connector opposing part on the front side of the housing and enclosing a housing front face portion; wherein the housing is interposed between the rear faceplate and the front faceplate, and the front faceplate is fixed to the rear faceplate by at least one fixing member extending in the front and rear direction in the housing.

With such an aspect, the front faceplate is disposed on the mate connector opposing part of the front side of the housing and encloses the front side of the housing. Also, the housing is interposed between the rear faceplate and the front faceplate and the rear faceplate is fixed to the front faceplate by at least one fixing member that extends in the front and rear direction in the housing. Therefore, in the housing, the mate connector opposing part side with the contactor provided can be completely covered by the front faceplate. Also, the front faceplate can be fixed by the fixing member and the rear faceplate. By the above, the leakage of electromagnetic waves from the housing can be more reliably suppressed.

Effect of the Invention

According to one aspect of the present invention, the leakage of electromagnetic waves from the housing can be more reliably suppressed.

EMBODIMENTS FOR CARRYING OUT THE INVENTION

Figure 1:
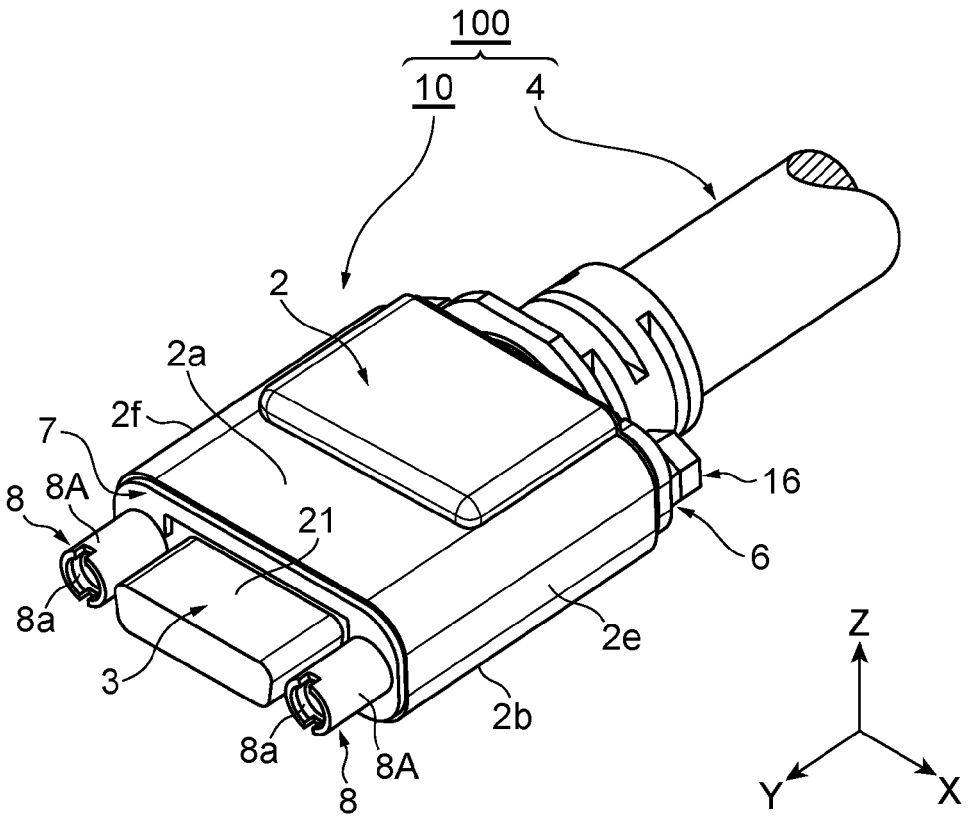
FIG. 1 is a perspective view of the cable assembly with connector and the connector assembly according to an embodiment.
Figure 2:
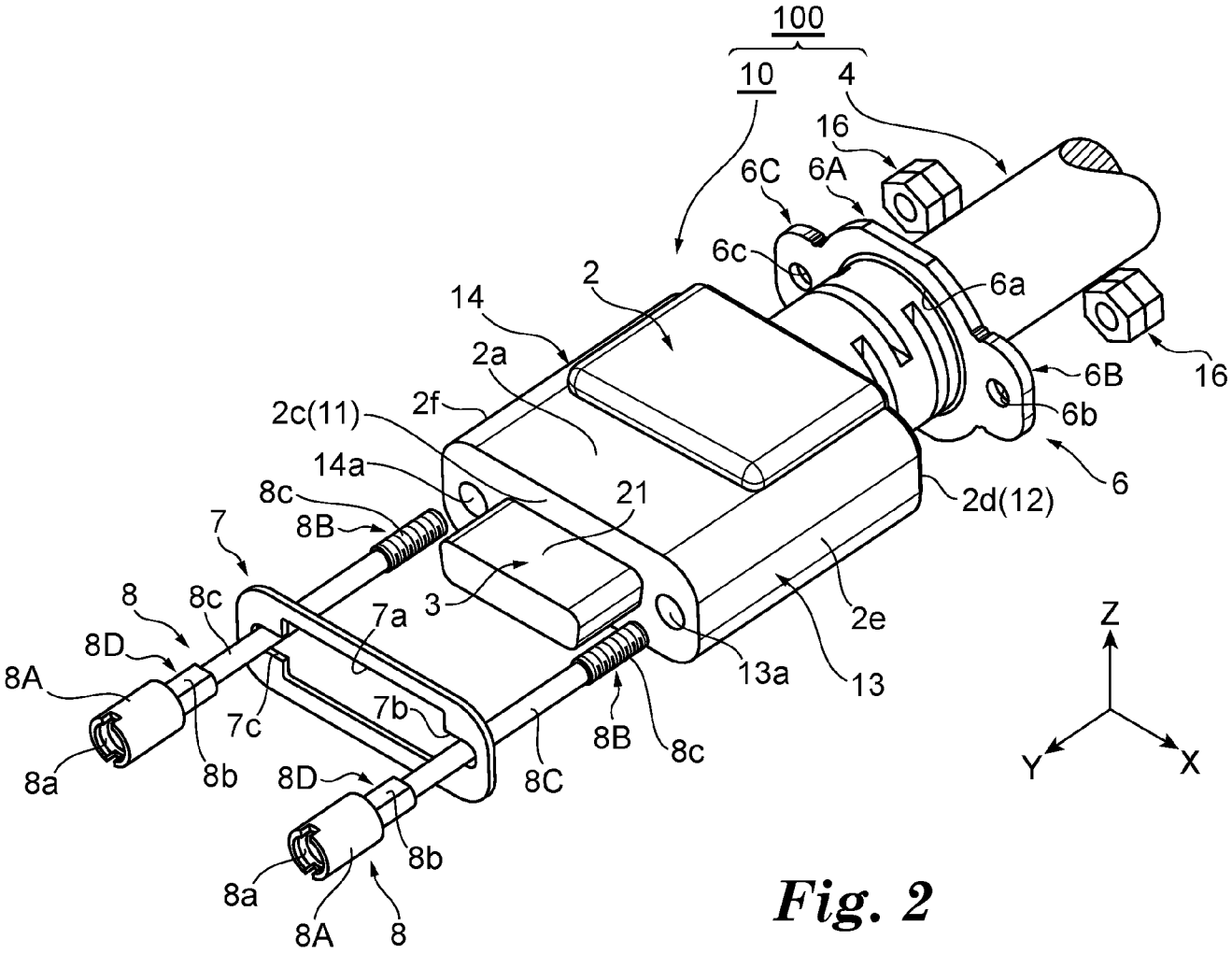
FIG. 2 is an exploded perspective view of the cable assembly with connector and the connector assembly according to an embodiment.
Figure 3:
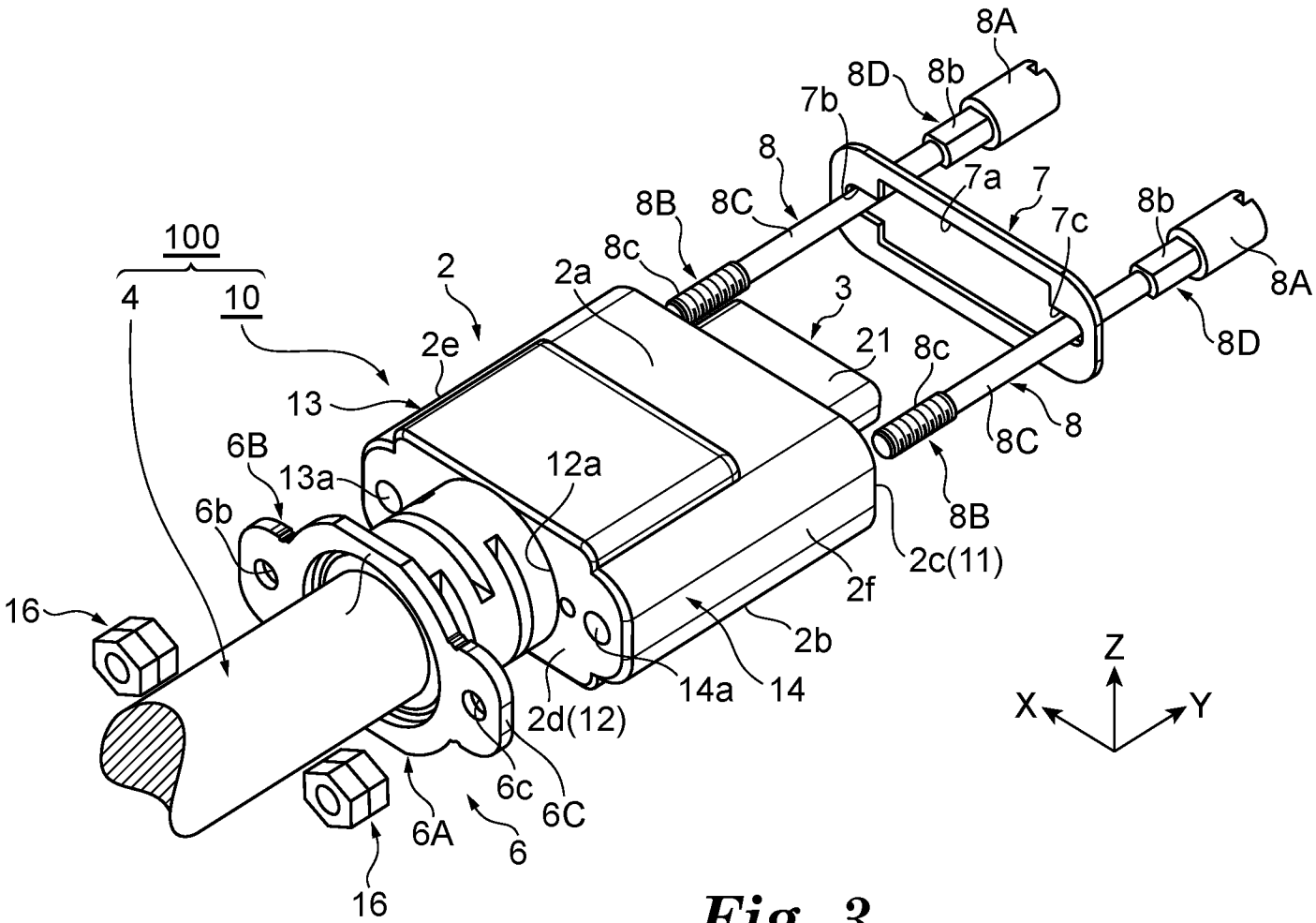
FIG. 3 is an exploded perspective view of the cable assembly with connector and the connector assembly according to an embodiment.

Embodiments of the present invention are described below in detail with reference to the attached drawings. Note that in the following description, the same reference numerals will be attached to identical or equivalent elements and duplicate descriptions will be omitted. Also, the terms for the [X axis direction], [Y axis direction], and [Z axis direction] are based on the illustrated directions and are for convenience.

As illustrated in FIG. 1 to FIG. 4, a cable assembly with connector 100 is provided with a housing 2, a contactor 3, a cable 4, a rear faceplate 6, a front faceplate 7, and a screw member (fixing member) 8. Of these, a connector assembly 10 is configured of the housing 2, contactor 3, rear faceplate 6, front faceplate 7, and screw member 8. The cable assembly with connector 100 according to the present embodiment is for electrically connecting like cables by fitting with another connector assembly of a connector assembly 200 (see FIG. 5) of a corresponding mate side. The use of the cable assembly with connector 100 according to the present embodiment is not particularly limited, but it may apply to a cable for electrically connecting, for example, a camera of a substrate inspection device to a computing unit. The cable assembly with connector 100 is particularly suited for use in a device that handles high frequency wave signals.

Note that the descriptions in the present specification provide a standard in which a cable 4 extends in a horizontal direction, one main face 2*a* of the housing 2 is arranged on the upper side, and another main face 2*b* is arranged on the lower side (the state illustrated in FIG. 1). However, at the time of use of the cable assembly with connector 100, the orientation is not limited. Also, for convenience in the description, an XYZ coordinate system will be established relative to the cable assembly with connector 100. The "X axis direction" and the "Y axis direction" are defined as planes mutually intersecting at right angles in the horizontal direction, and the "Z axis direction" is defined as a plane intersecting the X axis direction and the Y axis direction at a right angle. In the claims, the "front-rear direction" corresponds to the Y axis direction, the "front side" corresponds to the Y axis direction positive side, and the "rear side" corresponds to the Y axis direction negative side. Further, in the claims, the "lateral side" corresponds to the X axis direction positive side or the X axis direction negative side. The direction opposing the main faces 2*a* and 2*b* of the housing 2 is the Z axis direction, the side where the main face 2*a* is disposed is the Z axis direction positive side, and the side where the main face 2*b* is disposed is the Z axis direction negative side. Furthermore, to the extent that there are no references, the following description is based on the assembled state of the cable assembly with connector 100 (i.e., the state of FIG. 1).

The housing 2 is a member for protecting a portion where the contactor 3 and the cable 4 are electrically connected and stowed therein. The housing 2 has a shape of a flat cuboid and is provided with main faces 2*a* and 2*b* facing opposite Z axis directions, a housing front face portion 2*c* and a housing rear face portion 2*d* facing opposite Y axis directions, and side faces 2*e* and 2*f* facing opposite X axis directions. The housing front face portion 2*c* is formed on the front side (Y axis direction positive side) of the housing 2 and the housing rear face portion 2*d* is formed on the rear side (Y axis direction negative side) of the housing 2. The side face 2*e* is formed on one lateral side (X axis direction positive side) and the side face 2*f* is formed on the other lateral side (X axis direction negative side). The housing 2 is provided with a mate connector opposing part 11 provided on the front side, a cable part 12 provided on the rear side, and lateral side parts 13 and 14 provided on the lateral sides. Further, a connecting portion of the contactor 3 and cable 4 are housed inside of the housing 2.

The mate connector opposing part 11 is formed on the housing front face portion 2*c* side of the housing 2 and is a part for mutually fitting with another mate side connector opposing part. An opening is formed in the mate connector opposing part 11 to allow the contactor 3 arranged on the inside of the housing 2 to protrude externally. The opening is formed in substantially the center position of the housing front face portion 2*c*. The cable part 12 is formed on the housing rear face portion 2*d* side of the housing 2 and is a part for coupling with the tip end portion of the cable 4. A cable opening 12*a* (see FIG. 3) is formed on the cable part 12 to pull out the cable 4 disposed in an inner space to the outside. The cable opening 12*a* is formed in substantially the center position of the housing rear face portion 2*d*. The lateral side parts 13 and 14 are formed on the side faces 2*e* and 2*f* of the housing 2 and are parts for allowing the screw member 8 to be inserted. Lateral side openings 13*a* and 14*a* are formed on the lateral sides 13 and 14 for allowing the screw member 8 to be inserted. The lateral side openings 13*a* and 14*a* are cylindrical shaped through holes for penetrating in the front and rear direction between the housing front face portion 2*c* and the housing rear face portion 2*d* of the housing 2. Note that as long as the lateral side openings 13*a* and 14*a* are passing through between the housing front face portion 2*c* and the housing rear face portion 2*d*, a through hole is not required but a groove portion or the like that is open to the side faces 2*e* and 2*f* sides may be used.

Figure 4:
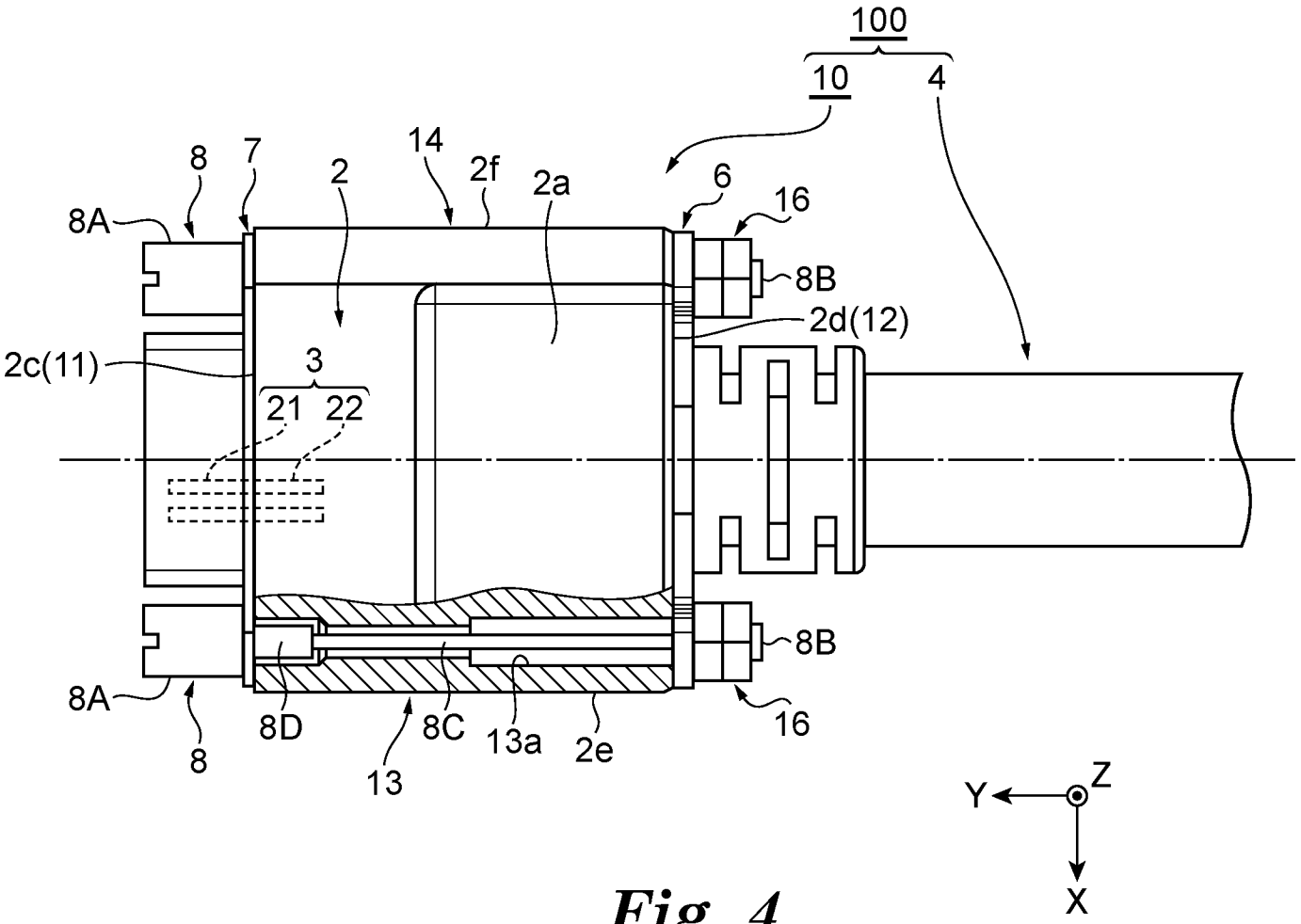
FIG. 4 is a partial cross-sectional view of the cable assembly with connector and the connector assembly according to an embodiment.
Figure 5:
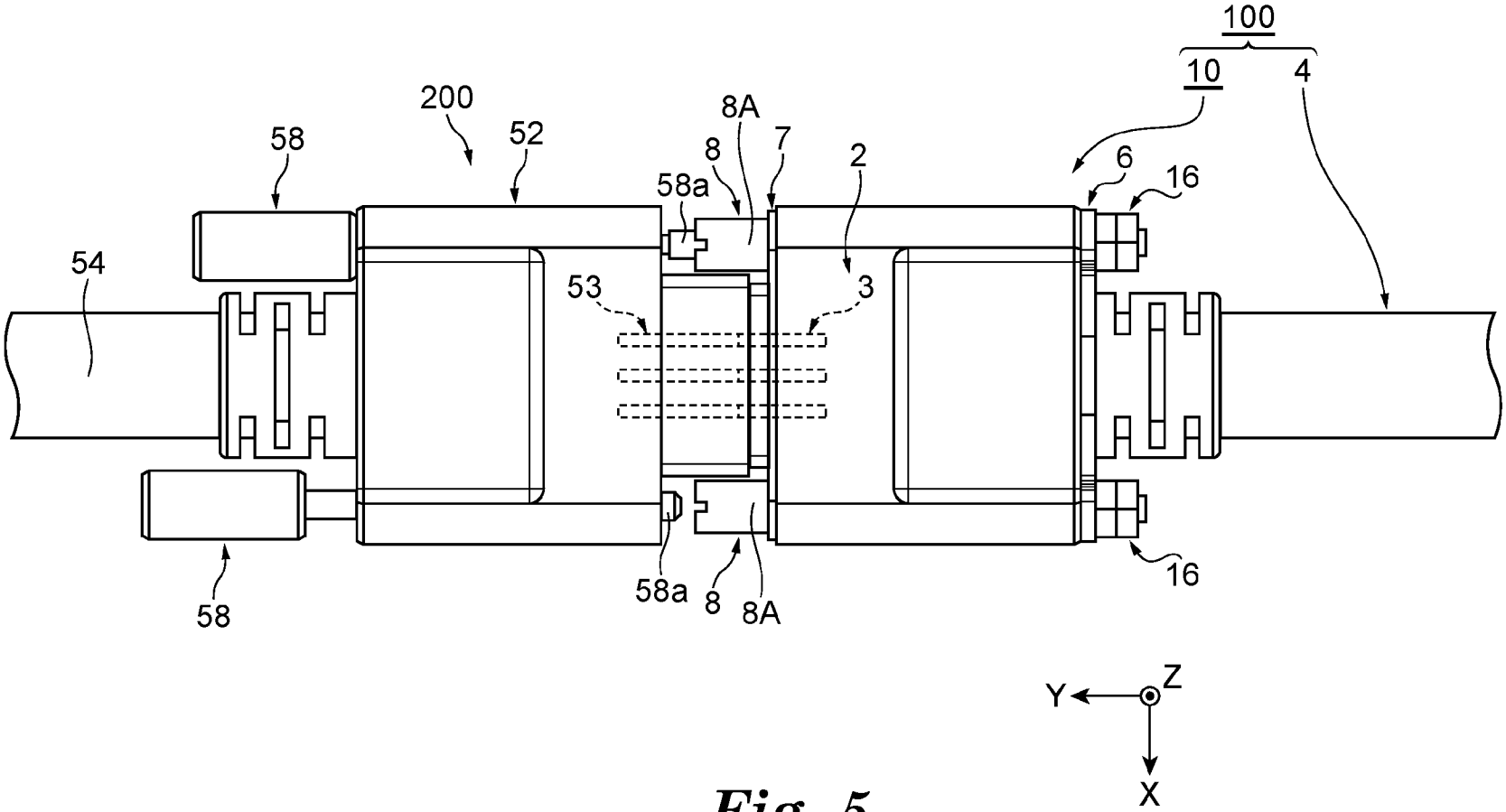
FIG. 5 is a plan view that illustrates another cable assembly with connector and a connector assembly connected to the cable assembly with a connector and the connector assembly according to an embodiment.

As illustrated in FIG. 4, the contactor 3 is provided on the mate connector opposing part 11 side of the housing 2 and is a conductive member that can be fitted to the contactor 53 (see FIG. 5) of the cable assembly with connector 200 of the corresponding mate side. The contactor 3 is provided with a terminal part 22 (refer to FIG. 4) in plurality connected respectively to a plurality of individual insulated wires of the cable 4 and with a fitting portion 21 that fits with the cable assembly with connector 200 on the corresponding mate side. The fitting portion 21 protrudes in the front direction from the mate connector opposing part 11 on the housing 2 via the opening on the housing 2. The fitting portion 21 fits with the fitting portion of the contactor 53 of the corresponding cable assembly with connector 200. The cable 4 is pulled out to the outside from the cable part 12 via the cable opening 12*a* from the inner portion of the housing 2. The plurality of terminal parts 22 of the contactor 3 are each electrically connected to the corresponding contactors on the cable assembly with connector 200. By this, each of the individual insulated wires of the cable 4 are electrically connected to each of the individual insulated wires of the cable 54 of the cable assembly with connector 200.

In the present embodiment, the housing 2 is formed by an over mold. In other words, the housing 2 is formed by resin molding containing the cable 4 and the contactor 3 electrically connected together. Specifically, after the cable 4 and the contactor 3 are connected, then primary molding is performed with resin. Following that, the entire circumference of the main body is wrapped in conductive tape excluding the front face and rear face of the primary molded body. Following that, the housing 2 is formed (secondary molding) in a manner of wrapping around the conductive tape. When formed by the over mold in this manner, it is suited for a thermoplastic material, such as polyvinyl chloride (PVC), polyamide, polyurethane, santoprene, polybutylene terephthalate (PBT), and the like as the resin for the housing 2.

The rear faceplate 6, being disposed on the cable part 12 on the housing rear face portion 2*d* of the housing 2, is a member for aligning the shape of the housing rear face portion 2*d* and the cable opening 12*a*. The rear faceplate 6 is provided with a center part 6A that is formed in the center position in the X axis direction, a lateral side part 6B formed to protrude to the X axis direction positive side from the center part 6A, and a lateral side part 6C formed to protrude to the X axis direction negative side. Further, a center opening 6*a* aligning with the cable opening 12*a* and lateral side openings 6*b* and 6*c* each formed on both of the lateral sides of the center opening 6*a* are formed on the rear faceplate 6. The center opening 6*a* is a through hole formed in the center part 6A which communicates to the cable opening 12*a* to allow the cable 4 to penetrate through. The lateral side openings 6*b* and 6*c* are through holes formed on the lateral side parts 6B and 6C which respectively communicate to the lateral side openings 13*a* and 14*a* on the housing 2 to allow the screw member 8 to penetrate through. During assembly, the rear faceplate 6 contacts the housing rear face portion 2*d* on the housing 2. Note that the center opening 6*a* and the lateral side openings 6*b* and 6*c* may not be through holes, but may also be formed by providing a notch in the outer edge portion of the rear faceplate 6.

The front faceplate 7 is disposed on the mate connector opposing part 11 of the housing front face portion 2*c* side of the housing 2 and is a member for enclosing the housing front face portion 2*c*. The external form of the front faceplate 7, when viewed from the Y axis direction, is substantially the same shape as the external form of the housing front face portion 2*c*. However, the external form of the front faceplate 7 may be a different shape or size from the external form of the housing front face portion 2*c*. The center opening 7*a* aligned with the contactor 3 and the lateral side openings 7*b* and 7*c* each formed on both of the lateral sides of the center opening 7*a* are formed on the front faceplate 7. The center opening 7*a* is formed in a shape that encloses the fitting part 21 of the contactor 3, and the fitting part 21 penetrates through. The lateral side openings 7*b* and 7*c* are penetrating portions formed by notching the edge portion of the lateral side of the center opening 7*a* such that respectively communicating to the lateral side openings 13*a* and 14*a* of the housing 2 allows the screw member to penetrate through, respectively. Note that the shape of the lateral side openings 7*b* and 7*c* will be described hereinafter together with the structure of the screw member 8. During assembly, the front faceplate 7 contacts the housing front face portion 2*c* of the housing 2. Note that the center opening 7*a* and the lateral side openings 7*b* and 7*c* may not be through holes, but may also be formed by providing a notch in the outer edge portion of front faceplate 7. However, it is preferable that the entire circumference of the front faceplate 7 completely covers the housing front face portion 2*c* without gaps in order to shield the electromagnetic waves on the housing front face portion 2*c* side. However, it is not required that the front faceplate 7 completely cover the housing front face portion 2*c* and may have a portion that is partially uncovered.

The screw member 8, extending in the front and rear direction in the housing 2, is a member for fixing the front faceplate 7 to the rear faceplate 6. The screw member 8 is provided with, in order from front to rear, a cap part 8A, a rotation stop 8D, a hook-up part 8C, and a rear end part 8B.

The cap part 8A is provided on the front end side of the screw member 8 and is a cylindrical shaped member with a female screw part 8*a* formed on the inner circumferential surface. The cap part 8A is open on the front end side and can receive a male screw part 58*a* of the screw member 58 of the cable assembly with connector 200 of a corresponding mate side (see FIG. 5). The cap part 8A and the female screw part 8*a* are external to the housing 2 and protrude to the front side from the front faceplate 7.

The rear end part 8B is provided on the rear end side of the screw member 8 and is a part with the female screw part 8*c* formed on the outer circumferential surface. The rear end part 8B is external to the housing 2 and protrudes to the rear side from the rear faceplate 6. A nut 16 is fastened to the male screw part 8*c* of the rear end part 8B. The nut 16 is fastened in twos (known as a double nut), and by this, loosening of the screw member 8 is prevented.

The rotation stop 8D is formed on the rear end part of the cap part 8A. At least one part of the rotation stop 8D is disposed on the inside of the lateral side openings 7*b* and 7*c* of the front faceplate 7. The rotation stop 8D opposes the edge portion on both sides in the Z axis direction of the lateral side openings 7*b* and 7*c* and is provided with a receiving face 8*b* that prevents rotation of the screw member 8 through contact. The receiving face 8*b* is formed by planar notching a portion of the circumferential surface of the cylinder. The receiving face 8*b* is formed on the positive side and negative side in the Z axis direction mutually in parallel.

The hook-up part 8C is a part that couples the cap part 8A provided with the female screw part 8*a* and the rear end part 8B provided with the male screw part 8*c*. The rotation stop 8D is disposed between the hook-up part 8C and the cap part 8A. At least one part of the hook-up part 8C is disposed on the inside portion of the housing 2, in other words, in the lateral side openings 13*a* and 14*a*.

Figure 6:
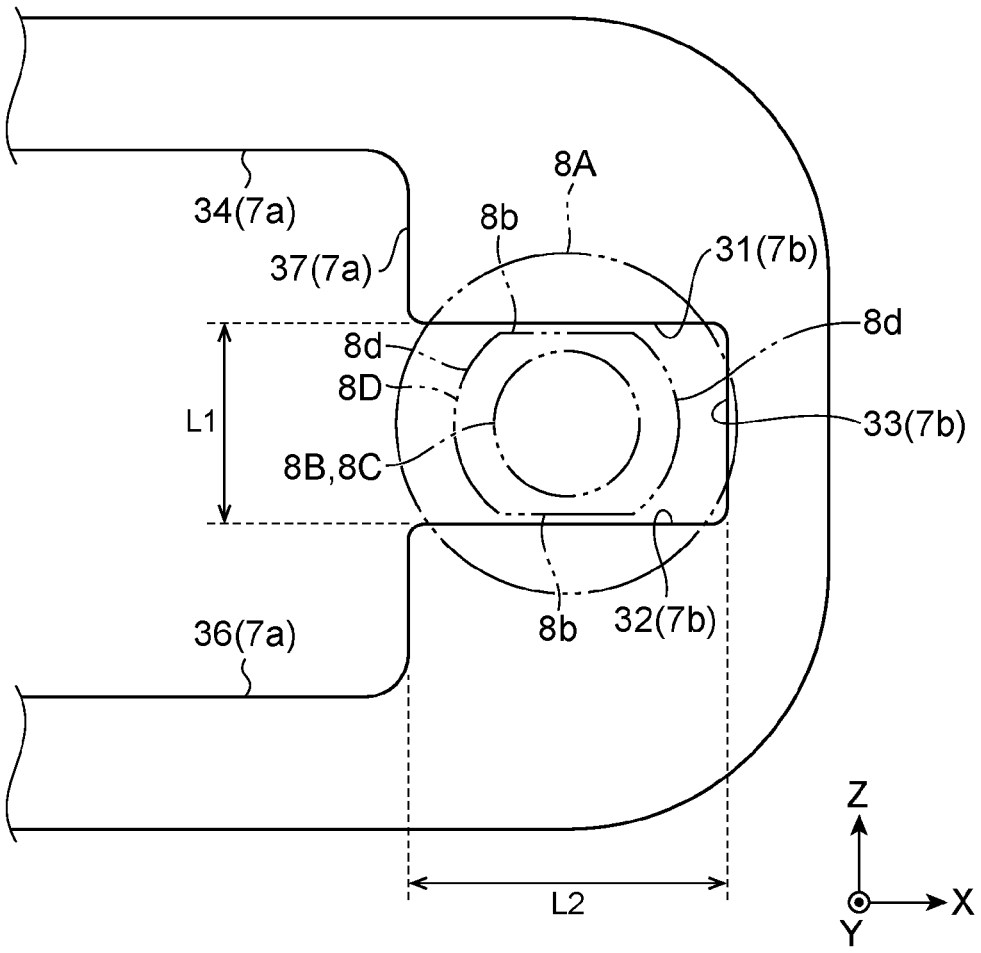
FIG. 6 is an enlarged view of the front faceplate.

The dimensional relationship between each part of the screw member 8 and the lateral side opening 7*b* is described herein with reference to FIG. 6. Note that, since the dimensional relationship between each part of the screw member 8 and the lateral side opening 7*c* is in essence the same as that to the lateral side opening 7*b*, the description thereof is omitted.

As illustrated in FIG. 6, the center opening 7*a* is provided with edge parts 34 and 36 that extend in the X axis direction and an edge part 37 that extends in the Z axis direction. The lateral side opening 7*b* is formed so as to extend toward the X axis direction positive side from the edge part 37 of the center opening 7*a*. The lateral side opening 7*b* is provided with edge parts 31 and 32 that extend in the X axis direction and an edge part 33 that extends in the Z axis direction. The edge part 31 of the lateral side opening 7*b* is disposed more to the Z axis direction negative side than the edge part 34 of the center opening 7*a*. The edge part 32 of the lateral side opening 7*b* is disposed more to the Z axis direction positive side than the edge part 36 of the center opening 7*a*. The edge part 33 of the lateral side opening 7*b* is disposed more to the X axis direction positive side than the edge part 37 of the center opening 7*a*.

The dimension L1 in the Z axis direction between the edge part 31 and the edge part 32 of the lateral side opening 7*b* is larger than the diameter of the rear end part 8B and the hook-up part 8*c*. By this, the lateral side opening 7*b* can be inserted through the rear end part 8*b* of the screw member 8 and the hook up part 8*c*. The dimension L1 is larger than the dimension in the Z axis direction between the receiving face 8*b* of the rotation stop 8D. On the other hand, the dimension L1 is smaller than the diameter of an arc surface 8*d* other than the receiving face 8*b* of the rotation stop 8D. Accordingly, when there is an attempt to rotate the rotation stop 8D while disposed inside the lateral side opening 7*b*, the receiving face 8*b* interferes with the edge parts 31 and 32 thus preventing the rotation of the screw member 8. The dimension L1 is smaller than the diameter of the cap part 8A. Therefore, the cap part 8A cannot pass through the lateral side opening 7*b* due to the contact between rear end face and the edge parts 31 and 32. By this, the cap part 8A can suppress the vicinity of the lateral side part 7*b* of the front faceplate 7 with respect to the housing 2 from the rear side. Note that the dimension L2 in the X axis direction between the edge part 37 and the edge part 33 should be held to a size to an extent that it does not interfere with the rear end part 8B of the screw member 8, the hook-up part 8C, and the rotation stop 8D. Note that the lateral side opening 7*b* is coupled to the center opening 7*a* and is formed as an integrated through hole, but the lateral side opening 7*b* and the center opening 7*a* may be mutually independent through holes. In other words, the lateral side opening 7*b* and the center opening 7*a* may be partitioned at a part of the edge part 37.

Having such configuration as described above, the housing 2 is interposed between the rear faceplate 6 and the front faceplate 7. A pair of the screw member 8 passes through the lateral side openings 7*b* and 7*c* formed on corresponding locations of the front faceplate 7, passes through the lateral side openings 13*a* and 14*a* formed on corresponding locations (the lateral sides 13 and 14) in the housing 2, and passes through the lateral side openings 6*b* and 6*c* formed on the corresponding locations (the lateral sides 6B and 6C) of rear faceplate 6. The cap part 8A is disposed more to the front side than the front faceplate 7, at least one part of the rotation stop 8D is disposed on the inside of the lateral side openings 7*b* and 7*c*, at least one part of the hook-up part 8C is disposed on the inside of the lateral side openings 13*a* and 14*a*, and at least one part of the rear end part 8B is disposed more to the rear side than the rear faceplate 6. In this state, the male screw part 8*c* of the rear end part 8B is fixed by the nut 16 (double nut). By this, the front faceplate 7 is fixed to the rear faceplate 6 through the screw member 8 extending in the front and rear direction inside the housing 2. Also, the cap part 8A of the screw member 8 can put the front faceplate 7 into a state that presses against the housing 2. Therefore, the front faceplate 7, the housing 2, the rear faceplate 6, and the screw member 8 are all fixed at a mutually sufficient strength. The rotation of the screw member 8 is prevented by the rotation stop 8D being disposed in the lateral side openings 7*b* and 7*c*.

As described above, the cable assembly with connector according to one aspect of the present invention is provided with: a housing provided with a mate connector opposing part provided on a front side and a cable part provided on a rear side having a cable opening formed; a conductive contactor provided on the mate connector opposing part side of the housing, that can fit with the contactor of a corresponding connector; a cable disposed in the housing via the cable opening and electrically connected to the contactor; a rear faceplate disposed on the cable part on the rear side of the housing and aligned with the cable opening; and a front faceplate disposed on the mate connector opposing part on the front side of the housing and enclosing a housing front face portion; wherein the housing is interposed between the rear faceplate and the front faceplate, and the front faceplate is fixed to the rear faceplate by at least one fixing member extending in the front and rear direction in the housing.

With such an aspect, the front faceplate is disposed on the mate connector opposing part of the front side of the housing and encloses the front side of the housing. Also, the housing is interposed between the rear faceplate and the front faceplate and the rear faceplate is fixed to the front faceplate by at least one fixing member that extends in the front and rear direction in the housing. Therefore, in the housing, the mate connector opposing part side with the contactor provided can be completely covered by the front faceplate. Also, the front faceplate can be fixed by the fixing member and the rear faceplate. Before the secondary molding of the housing 2, conductive tape is wrapped around the entire circumference of the main body omitting the front face and rear face of the primary molded body. By the above, the leakage of electromagnetic waves from the housing can be more reliably suppressed.

Also, in the cable assembly with connector according to another aspect, the fixing member is configured of a pair of screw members disposed on both lateral sides of the housing, the screw member is provided with: a male screw part formed on the rear end side external to the housing and protruding to the rear side from the rear faceplate; a female screw part formed on the front end side external to the housing and protruding to the front side from the front faceplate; and a hook-up part coupling the male screw part and the female screw part, and at least a portion disposed on an inner portion of the housing; wherein the screw member penetrates through a lateral side hole formed in a corresponding location to the rear faceplate and penetrates through a lateral side hole formed in a corresponding location to the front faceplate. Accordingly, by fastening a nut and the like onto the male screw part of the rear end side of the screw member, the front face place can be fixed by the screw member and the rear faceplate. Further, the male screw part of the screw member of the connector of the corresponding mate side can be fastened to the female screw part of the front end side of the screw member.

Also, in the cable assembly with connector according to another aspect, the screw member and at least one lateral side opening of the front faceplate and the rear faceplate may be configured in a shape that prevents the screw member from rotating relative to the front faceplate and the rear faceplate. By this, when the male screw part of the connector of the corresponding mate side is rotated, the co-rotation of the screw member relative to the front face plate and the rear faceplate can be prevented. Therefore, the reliability of the coupling of like connectors can be improved.

Also, in the cable assembly with connector according to another aspect, the center opening aligned with the cable opening and lateral side openings formed respectively on both lateral sides of the center opening may be formed on the rear faceplate. By this, a fixing member (the screw member) can penetrate through both of the lateral side openings respectively. Therefore, the rear face plate can configured as one single plate.

Also, in the cable assembly with connector according to another aspect, the housing is formed by resin molding including the contactor and the cable mutually electrically connected. When the housing is formed by resin molding for improvement of the operability, there are times that soft resin is used. Therefore, for example when attempting to fix the screw member to the housing itself, there is a possibility that through the force of rotation the housing will deform. On the other hand, by the configuration of interposing the housing between the rear plate and the front plate and gaining the repulsive force of the housing, subduction can be suppressed. Also, in the rear side of the rear faceplate, by fastening the male screw part of the screw member with a nut, the force acting on the housing can be suppressed. Therefore, even if the housing is configured with a soft resin, a sufficient amount of torque can be placed on the screw member. Also, even when a manufacturing error occurs, handling for reworking can be performed simply.

As described above, the cable assembly with connector according to one aspect of the present invention is provided with: a housing provided with a mate connector opposing part provided on a front side and a cable part provided on a rear side having a cable opening formed; a conductive contactor provided on the mate connector opposing part side of the housing, that can fit with the contactor of a corresponding connector; a cable disposed in the housing via the cable opening and electrically connected to the contactor; a rear faceplate disposed on the cable part on the rear side of the housing and aligned with the cable opening; a front faceplate disposed on the mate connector opposing part on the front side of the housing and enclosing a housing front face portion; and a screw member disposed on both lateral sides of the housing; wherein the screw member penetrates through a lateral side opening formed in a corresponding location in the rear faceplate, and penetrates through a lateral side opening in a corresponding location in the front faceplate, and comprises a cap part on a front end side that presses the front faceplate and is formed by a female screw part and a rear end side formed by a male screw part so as to fix a nut, the housing being interposed between the rear faceplate and the front faceplate.

With such as aspect, the front faceplate is disposed on the mate connector opposing part of the front side of the housing and encloses the front side of the housing. Also, the housing is interposed between the rear faceplate and the front faceplate, and the front faceplate is fixed to the rear faceplate via the screw member. Therefore, in the housing, the mate connector opposing part side with the contactor provided can be covered by the front faceplate. Further, the front faceplate can be fixed by the screw member and the rear plate. By the above, leakage of electromagnetic waves from the housing can be more reliably suppressed. Furthermore, since the cap part of the front end side of the screw member has the female screw part, it can receive the male screw part of the screw member of the connector of the corresponding mate side. Also, the male screw part of the rear end portion is fixed by a nut, and since the cap part of the front end side can push the front faceplate, the housing can be sufficiently interposed between the front faceplate and the rear faceplate. In this manner, since the housing, the front faceplate, the rear faceplate, and the screw member are mutually in a properly fixed state even when the male screw part of the screw member of the connector of the mate side is fastened to the cap part, co-rotation of the screw member can be prevented.

The connector assembly according to one aspect of the present invention provides: a housing provided with a mate connector opposing part provided on a front side and a cable part provided on a rear side having a cable opening formed; a conductive contactor provided on the mate connector opposing part side of the housing, that can fit with the contactor of a corresponding connector; a rear faceplate disposed on the cable part on the rear side of the housing and aligned with the cable opening; a front faceplate disposed on the mate connector opposing part on the front side of the housing and enclosing a housing front face portion; wherein the housing is interposed between the rear faceplate and the front faceplate, and the front faceplate is fixed to the rear faceplate by at least one fixing member extending in the front and rear direction in the housing.

With such an aspect, in the same manner as the cable assembly with connector described above, the leakage of electromagnetic waves from the housing can be more reliably suppressed.

The present invention is not limited to the embodiment described above.

For example, in the embodiment described above, the housing is formed by an over mold, but the housing may also be a shell type. In this case, after connecting the cable to the contactor, the housing is configured by interposing with a housing of a partitioned shell shape and covering.

In the embodiment described above, by the mutually parallel edge parts 31 and 32 of the lateral side openings 7*b* and 7*c* of the front faceplate 7 and the mutually parallel receiving faces 8*b* and 8*b* of the rotation stop 8D of the screw member 8, a rotation stop structure is configured. However, the specific shape of the rotation stop structure is not particularly limited, and when the rotation stop 8D attempts to rotate, as long as it is a shape that prevents the rotation stop by interference with the lateral side openings 7*b* and 7*c* of front faceplate 7, then any shape may be employed. For example, the lateral openings 7*b* and 7*c* and the rotation stop 8D may be a polygonal shape such as a triangle, or a shape such as a key groove may also be employed.

In the embodiment described above, the rotation stop structure is only formed in the front faceplate, but it may also be formed on the rear faceplate and may also be formed on both the front faceplate and on the rear faceplate. Further, the rotation stop structure may also not be provided. Furthermore, it may also be a shape to stop rotation of the shape of the lateral side openings 13*a* and 14*a* of the housing 2.

Figure 7:
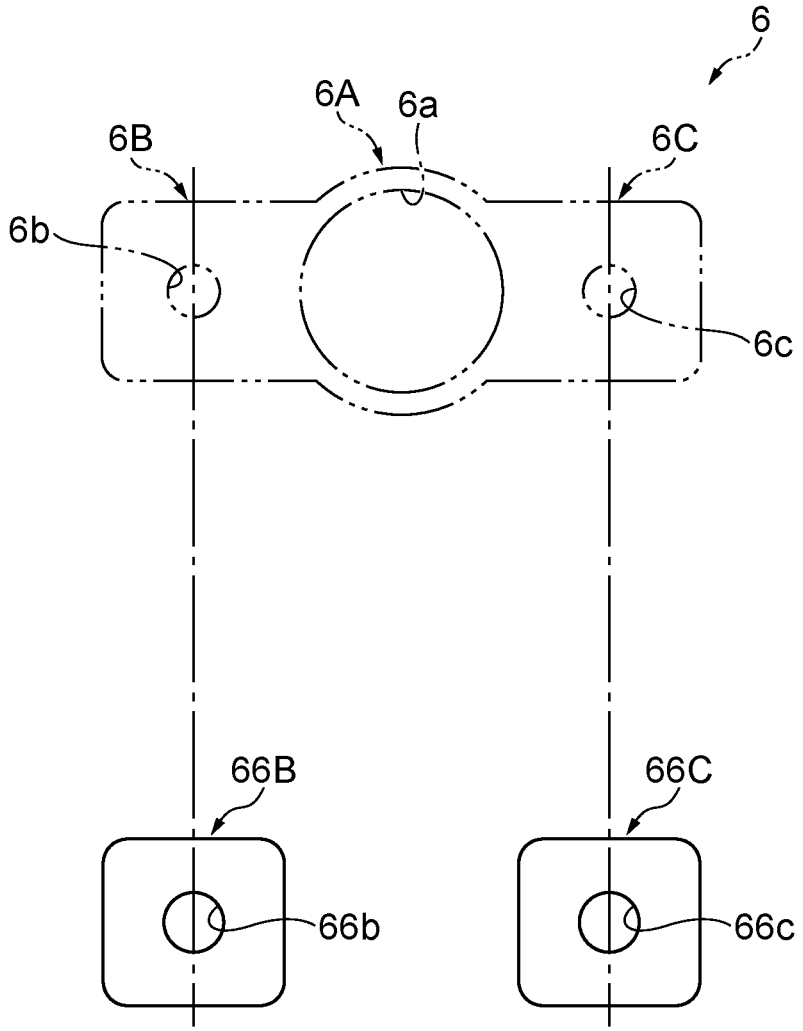
FIG. 7 is a diagram illustrating the rear faceplate of the cable assembly with connector and the connector assembly according to a modified example.

In the embodiment described above, in the rear face plate, the center opening and the lateral side openings are formed respectively on each lateral side of the center opening. In addition to this, as illustrated in FIG. 7, the rear faceplate is provided with a pair of lateral side plates 66B and 66C disposed respectively on both lateral sides of the cable opening, and lateral side openings 66*b* and 66*c* may be formed respectively in lateral side plates 66B and 66C. In this manner, mutually separated lateral side plates 66B and 66C can be disposed in positions corresponding to the lateral side parts 6B and 6C of the rear plate 6 described above.

In this manner, in the cable assembly with connector according to another aspect, the rear plate is provided with a pair of lateral plates disposed respectively on both lateral sides of the cable opening, and respective lateral side openings may be formed in the lateral side plate. In this manner, by partitioning the rear plate into a pair of lateral side plates, the shape per single plate can be simplified.

DESCRIPTION OF THE REFERENCE NUMERALS

2—housing, 3—contactor, 4—cable, 6—rear faceplate, 7—front faceplate, 8—s crew member (fixing member), 8A—cap part, 8B—rear end part, 10—connector assembly, 11—mate connector opposing part, 12—cable part, 100—cable assembly with connector.

What is claimed is:

1. A cable assembly with connector, comprising:

a housing provided with a mate connector opposing part provided on a front side and a cable part provided on a rear side having a cable opening formed;

a conductive contactor provided on the mate connector opposing part side of the housing, that can fit with the contactor of a corresponding connector;

a cable disposed in the housing via the cable opening and electrically connected to the contactor;

a rear faceplate disposed on the cable part on the rear side of the housing and aligned with the cable opening; and a front faceplate disposed on the mate connector opposing part on the front side of the housing and enclosing a housing front face portion; wherein the housing is interposed between the rear faceplate and the front faceplate, and the front faceplate is fixed to the rear faceplate by at least one fixing member extending in the front and rear direction in the housing, such that as the connector mates with and unmates from a corresponding connector, the front and rear faceplates remain tightly fixed to each other by the at least one fixing member.

2. The cable assembly with connector according to claim 1, wherein the fixing member is configured of a pair of screw members disposed on both lateral sides of the housing, the screw member comprising:

a male screw part formed on the rear end side external to the housing and protruding to the rear side from the rear faceplate;

a female screw part formed on the front end side external to the housing and protruding to the front side from the front faceplate; and a hook-up part coupling the male screw part and the female screw part, and at least a portion disposed on an inner portion of the housing; wherein the screw member penetrates through a lateral side hole formed in a corresponding location to the rear faceplate and penetrates through a lateral side hole formed in a corresponding location to the front faceplate.

3. The cable assembly with connector according to claim 2, wherein the screw member and at least one of the lateral side opening of the rear faceplate and the lateral side opening of the front faceplate are configured in a shape that prevents the screw member from rotating relative to the rear faceplate and the front faceplate.

4. The cable assembly with connector according to claim 1, wherein a center opening position aligned with the cable opening and lateral side openings respectively formed on both lateral sides of the center opening, are formed on the rear faceplate.

5. The cable assembly with connector according to claim 1, wherein the rear faceplate is provided with a pair of lateral side plates respectively disposed on both lateral sides of the cable opening, wherein respective lateral side openings are formed on the lateral side plate.

6. The cable assembly with connector according to claim 1, wherein the housing is formed by resin molding including the contactor and the cable mutually electrically connected.

7. A cable assembly with connector, comprising:

a housing provided with a mate connector opposing part provided on a front side and a cable part provided on a rear side having a cable opening formed;

a conductive contactor provided on the mate connector opposing part side of the housing, that can fit with the contactor of a corresponding connector;

a cable disposed in the housing via the cable opening and electrically connected to the contactor;

a rear faceplate disposed on the cable part on the rear side of the housing and aligned with the cable opening;

a front faceplate disposed on the mate connector opposing part on the front side of the housing and enclosing a housing front face portion; and a screw member disposed on both lateral sides of the housing; wherein the screw member penetrates through a lateral side opening formed in a corresponding location in the rear faceplate, and penetrates through a lateral side opening in a corresponding location in the front faceplate, and comprises a cap part on a front end side that presses the front faceplate and is formed by a female screw part and a rear end side formed by a male screw part so as to fix a nut, the housing being interposed between the rear faceplate and the front faceplate, such that as the connector mates with and unmates from a corresponding connector, the front and rear faceplates remain tightly fixed to each other by the screw members.

8. A connector assembly, comprising:

a housing provided with a mate connector opposing part provided on a front side and a cable part provided on a rear side having a cable opening formed;

a conductive contactor provided on the mate connector opposing part side of the housing, that can fit with the contactor of a corresponding connector;

a rear faceplate disposed on the cable part on the rear side of the housing and aligned with the cable opening;

a front faceplate disposed on the mate connector opposing part on the front side of the housing and enclosing a housing front face portion; wherein the housing is interposed between the rear faceplate and the front faceplate, and the front faceplate is fixed to the rear faceplate by at least one fixing member extending in the front and rear direction in the housing, such that as the connector mates with and unmates from a corresponding connector, the front and rear faceplates remain tightly fixed to each other by the screw members.

* * * * *